US005314392A

United States Patent [19]

Hawkins et al.

[11] Patent Number: 5,314,392

[45] Date of Patent: May 24, 1994

[54] PORTABLE PEDAL EXERCISER

[76] Inventors: Tranel Hawkins, 831 Spencer Ave., San Jose, Calif. 95125; Robert S. Smith, 1263 Emory St., San Jose, Calif. 95126

[21] Appl. No.: 75,742

[22] Filed: Jun. 11, 1993

[51] Int. Cl.[5] ..... A63B 22/04; A63B 22/06

[52] U.S. Cl. ..... 482/57; 482/52

[58] Field of Search ..... 482/57, 60, 62, 63, 482/64, 65, 66, 52, 53, 51

[56] References Cited

U.S. PATENT DOCUMENTS

| | | | |
|---|---|---|---|
| 2,668,709 | 2/1954 | Boyko | 482/60 |
| 3,259,385 | 7/1966 | Boren . | |
| 4,390,177 | 6/1983 | Biran et al. | 482/60 |
| 4,688,791 | 8/1987 | Long | 482/62 |
| 4,798,395 | 1/1989 | Shaffer et al. | 482/62 |
| 4,938,474 | 7/1990 | Sweeney . | |
| 5,116,294 | 5/1992 | Findlay . | |

FOREIGN PATENT DOCUMENTS

| | | | |
|---|---|---|---|
| 2037100 | 2/1972 | Fed. Rep. of Germany | 482/63 |
| 4090714 | 12/1967 | France | 482/63 |

*Primary Examiner*—Stephen R. Crow

*Attorney, Agent, or Firm*—Robert Samuel Smith

[57] ABSTRACT

A pedal exerciser for performing stepper exercises including a pair of pedal cranks, each crank driving one of a pair of crankshafts that are coupled together by bevel gears such that, when one pedal is forced to rotate downward, the other pedal rises thereby providing reciprocating stairclimbing motion. Adjustable resistance to stepping is provided by a resistance pad against either the idler bevel gear or one or both crankshafts. The compact construction is amenable to positioning the exerciser under a desk or table for a seated user. A detachable frame with handles may be attached for an erect user.

11 Claims, 3 Drawing Sheets

FIG. 5
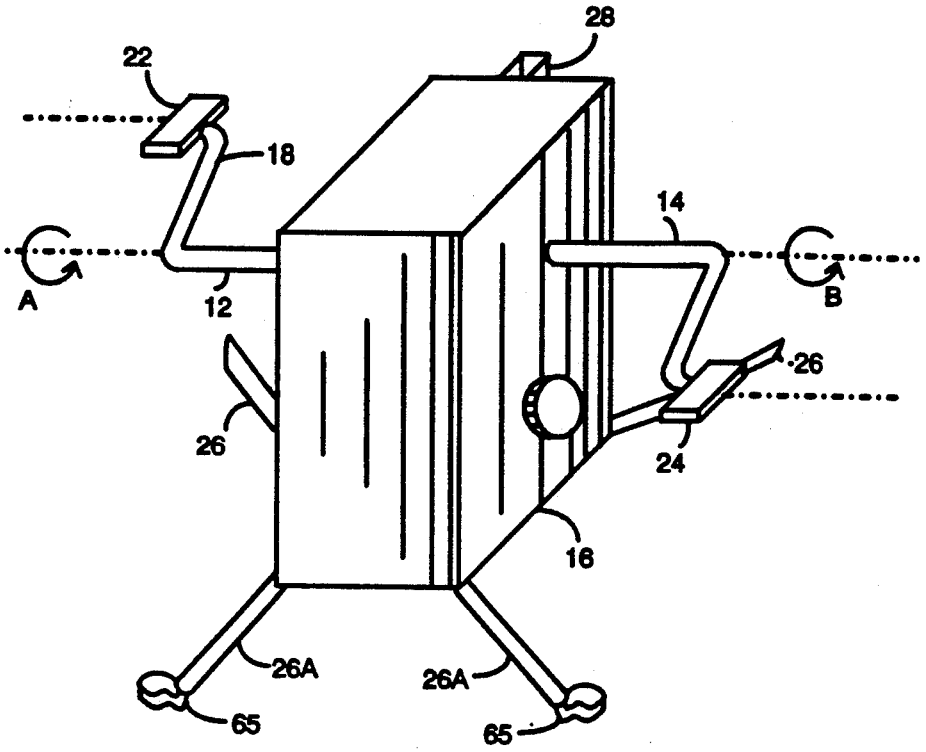
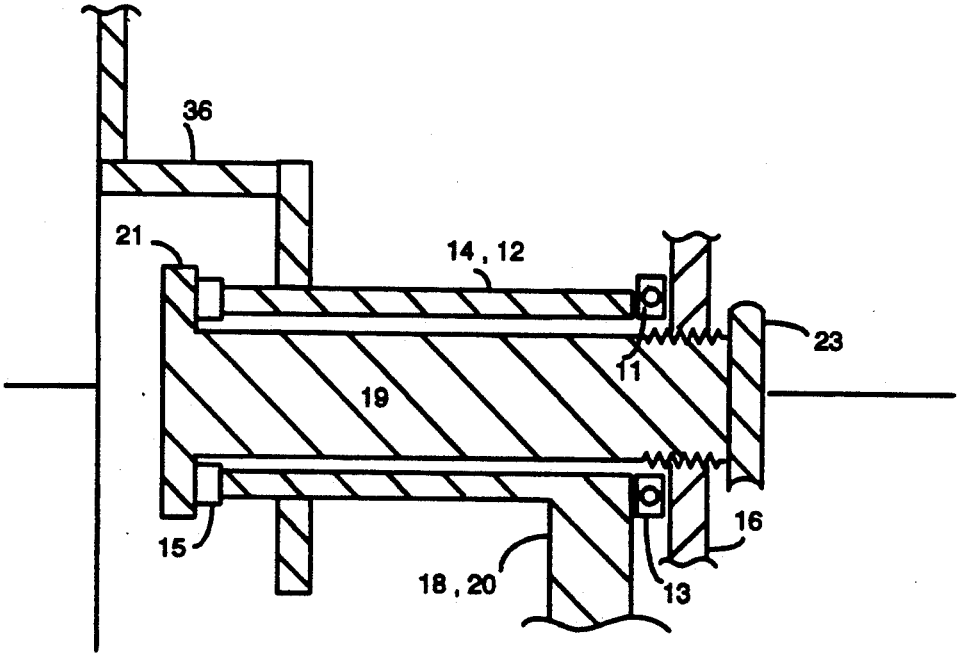
FIG. 4

PORTABLE PEDAL EXERCISER

BACKGROUND

1. Field of the Invention

This invention relates to pedal exercisers and particularly to an exerciser that is sufficiently compact that it can be stored and operated under a table or desk by a seated user.

2. Prior Art and Information Disclosure

Stepper exercisers that simulate the reciprocal pedalling motion of stair climbing have become well known in the market place and have appeared in numerous configurations. This type of exerciser is operated with the user standing erect and exerting force first with one foot and then the other with each pedal returning to a starting position with each step.

A well known design approach to this type of exerciser is exemplified by U.S. Pat. No. 5,116,294 to Findlay in which the up down motion of the pedal is translated to rotary motion by means of two straps extending over pulleys. Each strap has an end attached intermediate the ends of one of the pedal cranks and another end attached to an electromagnetic brake to provide resistance means.

U.S. Pat. No. 4,938,474 to Sweeney discloses a stair climber involving sprocket chains extending over sprocket gears. Each sprocket chain has one end attached intermediate the ends of the pedal crank and another end coupled through a one way clutch to a resistance wheel.

These designs are suitable for steppers in which the user is erect. They would not be practical for a portable exerciser and particularly for a stepper exerciser to be placed under a desk or table for use by a seated user because of the size that the mechanism inherently requires.

U.S. Pat. No. 3,259,385 to Boren discloses another type of pedalling exerciser designed for a seated user. The exerciser includes a pair of pedals which are driven in one rotational direction to turn a resistance wheel having an adjustable band for applying resistance to turning. The exerciser does not provide the stepper motion nor would it be suitable for operation under a desk or table because of the height of the device necessitated by the pedals rotating in a complete circle.

The Invention

Object

It is an object of this invention to provide an apparatus for exercising that can be conveniently located under a desk or table and operated by a seated user or operated with the user erect standing on the pedals.

It is another object that the exerciser be operated by a "stepper" motion in contrast to a "bicycle pedalling" motion.

It is another object that the exerciser be readily portable.

It is another object that the exerciser of this invention be characterized by a construction that is more compact than the stair climber apparatus disclosed in the prior art.

SUMMARY

This invention is directed toward a stepper exerciser with a pair of pedals in which the crank of each pedal is coupled through an arrangement of transmission gears to the other pedal such that each pedal operates in a reiprocal motion with respect to the other pedal. Each pedal crank is mounted to rotate one of a pair of crank shafts. A bevelled crank gear is mounted on each crankshaft and both crank gears engage a third common bevel gear so that when one pedal crank rotates in one direction, the other pedal crank rotates in the opposite direction thereby providing the reciprocating motion of the pedals. In one embodiment, adjustable resistance to rotation of the common bevel gear provides a desired resistance to performing the exercise. Resistance is provided by simply turning a knob which forces a resistance element against the support for the common bevel gear. The pedal cranks are oriented such that the pedals move in a substantially vertical direction. Compactness of the entire mechanism lends itself to positioning the device beneath a table or under a desk for convenient use by a seated user.

Drawings

FIG. 4 shows details of a differential screw arrangement for providing adjustable resistance to turning the crankshafts.

FIG. 5 shows straps for attaching the exerciser to the fron legs of the chair.

Description of a Best Mode

The following description presents variation and modifications of the invention including what I presently believe to be the best mode for carrying ouut the invention.

Figure 1:
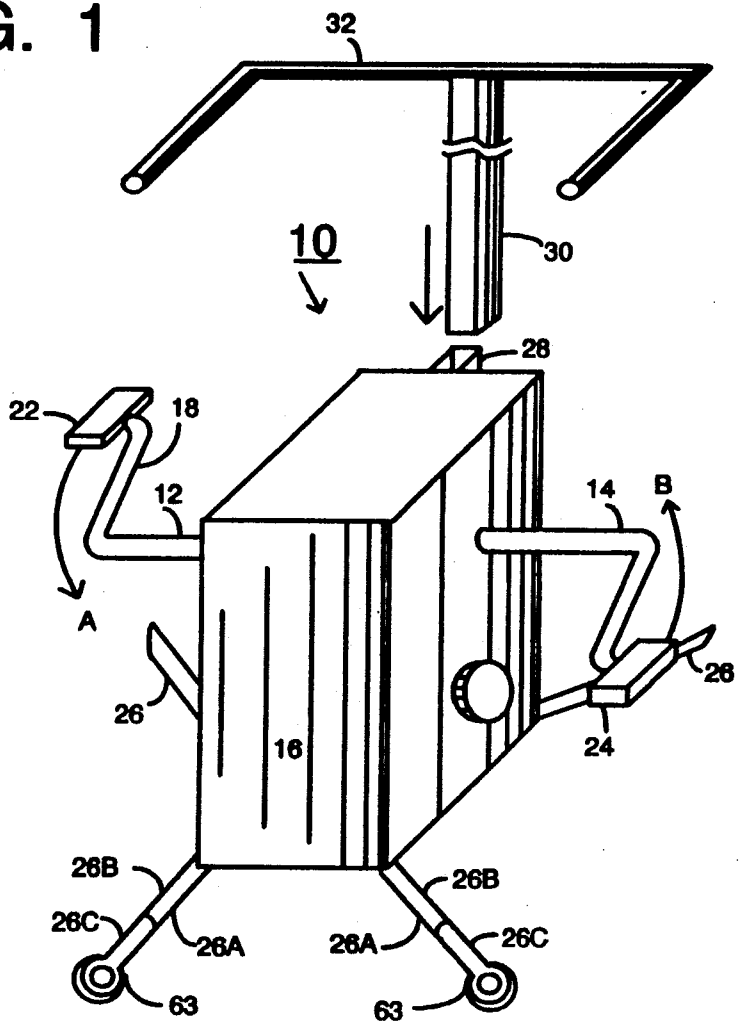
FIG. 1 is an assembly view of the exerciser of this invention

Turning now to a discussion of the drawings, FIG. 1 shows a perspective assembly view of the stepper exerciser of this invention in which a user pushes one pedal 22 downward (see arrow A) causing the other pedal 24 to rise (see arrow B) and vice versa. A pair of crank shafts, 12 and 14,extend from opposite sides of housing base 16 and are attached to one end of cranks, 18 and 20, respectively. A pedal, 22 and 24, is rotatably attached to crank, 18 and 20, respectively. The housing 16 is supported on the floor by four outstretched extensions 26 which stabilize the exerciser so that a user may position the exerciser under his chair or desk and perform the stepping exercise while in seated..

In order to further accomodate a seated user, FIG. 1 shows each of extensions 26A having two telescoping sections 26 B and 26 C. Section 26B is hinged to housing base 16 and section 26C is provided with recessed pods 63 into which the front legs of a chair (not shown) may be positioned.

In an additional embodiment, a square vertical tube 28 is attached to the back of the housing into which the stem 30 of a handle bar 32 may be telescoped if the user wishes to use the exerciser by standing erect on the pedals. 22 and 24.

Figure 2:
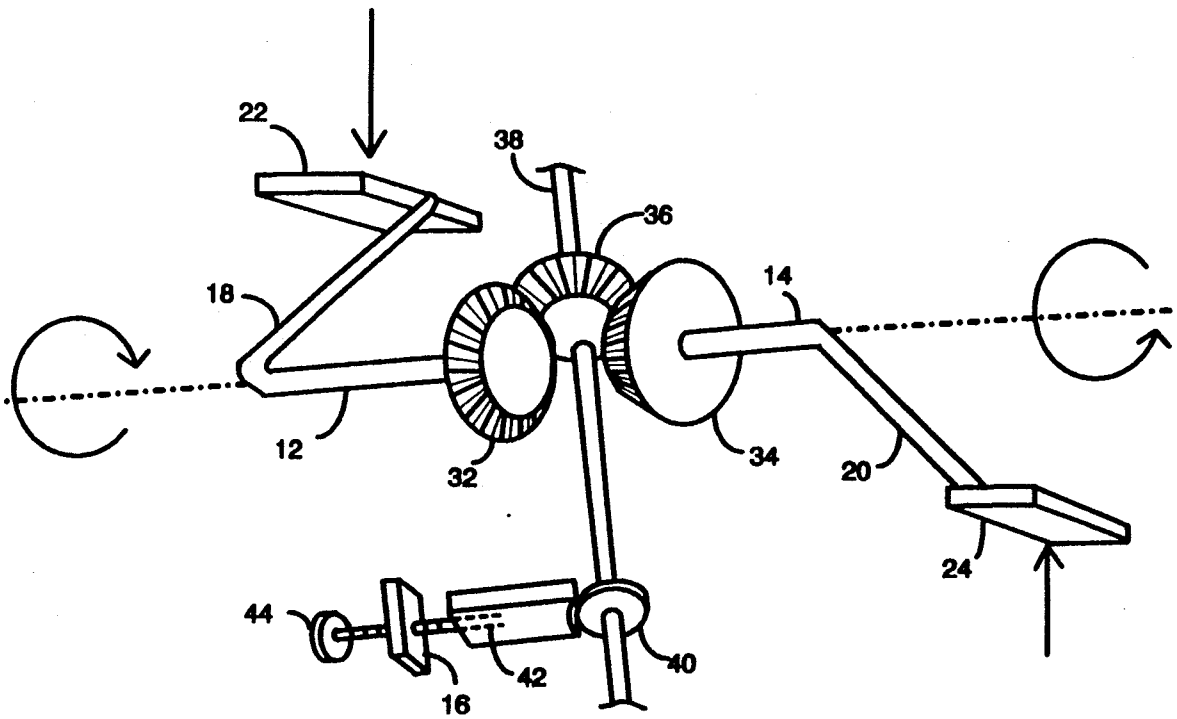
FIG. 2 shows the mechanical transmission for providing reciprocating pedal motion.

FIG. 2 shows the the transmission arrangement for providing the reciprocal action of the pedals and resistance to pedalling. (Housing base 16 is not shown in FIG. 2.) Crank 18 and 20 with pedals 22 and 24 are shown attached to cranks 12 and 14 respectively. Bevel gears 32 and 34 are mounted on crankshafts 12 and 14 respectively. Common bevel gear 36 is rotatably mounted on idler shaft 38 and engages both bevel gears 32 and 34. A resistance wheel 40 is mounted on idler shaft 38 and is engaged by brake shoe 42 whose force against resistance wheel 40 is adjustable by turning knob 44.

Figure 3:
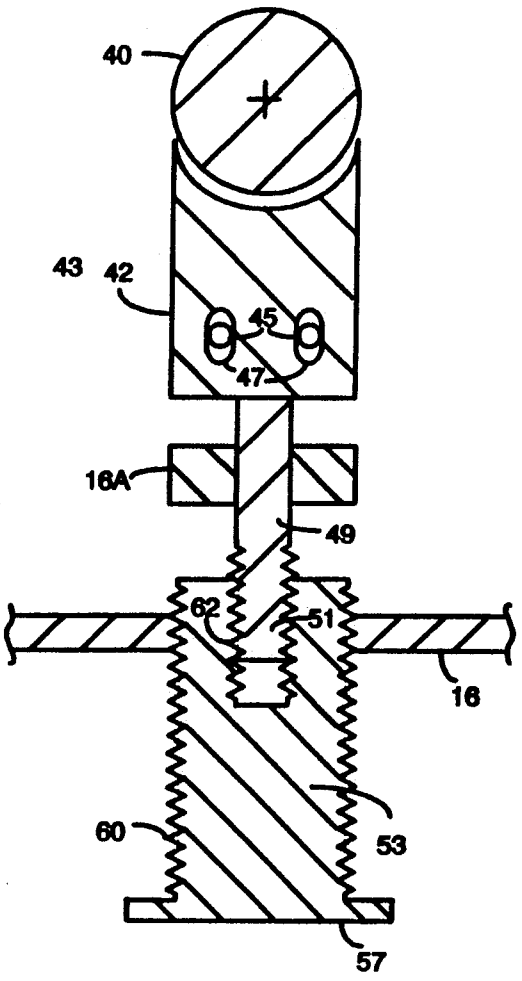
FIG. 3 shows another approach to applying resistance to the reciprocating pedal motion.

FIG. 3 shows details of a means for applying force of brake shoe 42 agains resistance wheel 40. Brake shoe 42 is constrained to slide in the direction of arrow 43 by pins 45 fixed in housing base 16 (not shown) and positioned in slots 47. Push rod 49 (sliding in base collar 16A) abuts brakeshoe 42 on one end and the other end 51 is threaded into bushing 53. The outer surface of bushing 53 is threaded by a second thread (different from the first thread) into the base housing wall 16. Bushing 53 is turned by turning knoib 57. Because the first thread is different than the second thread (in terms of threads per inch) much finer adjustment (control) of the force of the brakeshoe 42 against the resistance wheel 40 is provided. A suggested value of threads per inch of thread 60 is 20 and a suggested value of threads per inch of thread 62 is 16 although other thread combinations are readily workable.

In the foregoing paragraphs an embodiment has been described which meets the objects of the invention. A major feature of the invention is a pair of pedal cranks on crankshafts coupled to one another by a bevel gear on the crankshaft of each pedal engaging a common idler bevel gear. Other arrangements are suggested by reading the specification and studying the drawings. For example, the idler shaft could be oriented horizontally thereby reducing the overall height of the exerciser.

FIG. 4 shows another arrangement incorporating the principles of the invention in which the crankshaft 12 or 14 is a tube positioned against the inner race 11 of bearing 13 on one end and resistance pad 15 on the other end. A rod 25 with a section 19 threaded into housing wall 16 is located within the tubular crankshaft 12, 14 and has a shoulder 21 forcing the resistance pad 15 against the end of the crankshaft 12, 14 with a force that is adjustable by turning knob 23 on the outside end of rod 19 . This arrangement thereby provides an adjustable resistance to the pedalling motion that is an alternative to the arrangement shown in FIG. 2.

FIG. 5 shows an alternative arrangement for securing the position of the exerciser relative to the chair in whicn includes a pair of straps 65, one strap 65 secured to one of legs 26A respectively.

In view of the various embodiments that are within the scope of this invention, I wish to define the scope of my invention by the appended claims.

I claim:

1. An exerciser which comprises:

a housing base adapted for positioning on a floor;

a pair of crankshafts rotatably mounted in said housing base positioned on a common center line;

a pair of bevel gears, one gear of said pair mounted on one of said crankshafts, respectively;

a third bevel gear with an idler shaft rotatably mounted in said housing base and engaging both said gears of said pair of bevel gears such that when one crankshaft turns in one direction, the other crankshaft turns in an opposite direction;

a pedal crank having a pedal on one end and another end secured substantially perpendicularly to one of said crank shafts respectively;

means for applying an adjustable resistance to turning said crankshafts.

2. An exerciser as in claim 1 wherein said adjustable resistance means comprises:

a resistance wheel mounted on said idler shaft;

a brake shoe slidably mounted on said housing base;

means for forcing said brakeshoe against said resistance wheel.

3. An exerciser as in claim 2 wherein said forcing means is a push rod threaded into a section of said housing base and having one end supporting said brake shoe against said resistance wheel and a knob on another end accessible to a user.

4. An exerciser as in claim 3 wherein said section of said housing base is a part of a wall of said housing base.

5. An exerciser as in claim 2 wherein said forcing means comprises:

a push rod slidably mounted on said housing base and having one end abutting said brake shoe and a first thread on another end;

a bushing threaded with a second thread into said housing base and having a knob on one end accessible to a user and a bore with said first thread opening at said second end and engaging said threaded end of said pushrod;

said first thread having a value of threads per inch that is different than threads per inch of said second thread thereby providing that sensitivity of adjusting force of said brakeshoe against said resistance wheel by turning said knob is determined by a difference of said first and second threads per inch.

6. An exerciser as in claim 1 wherein said adjustable resistance means comprises:

a pushrod threaded through said housing base and having one end with a knob accessible to a user and another end;

a resistance pad with a first surface abutting said another end of said push rod and a second surface abutting an end of one said crankshafts;

said crankshaft, resistance pad, and pushrod arranged in combination with one another such that a force of said resistance pad against said end of said crankshaft is adjustable by turning said knob.

7. An exerciser as in claim 1 which comprises:

a means with handles and detachably engaged with said housing base adapted for permitting a user to stand with one foot on one of said pedals respectively, grasp said handles, and move said pedals in a reciprocating motion simulating stairclimbing.

8. An exerciser as in claim 1 which comprises a plurality of extensions, each having one end secured to said housing base and adapted to rest on a floor and support said exerciser such that said pedal cranks rotate about an axis that is substantially horizontal.

9. An exerciser as in claim 8 wherein at least one of said extensions has two telescoping sections and one end of said extensions hingably to said housing base and roatably positionable in a horizontal plane such as to accomodate a seated user.

10. An exerciser as in claim 9 wherein an outreaching end of said at least one extension has a recessed pod adapted for receiving a leg of a chair of said user.

11. An exerciser as in claim 8 which comprises a pair of straps, one strap attached to an outreaching end of one extension respectively, each strap adapted for attachment to a leg of a chair.

* * * * *